US005350296A

United States Patent [19]

Wikström

[11] Patent Number: 5,350,296

[45] Date of Patent: Sep. 27, 1994

[54] METHOD AND DEVICE FOR COOLING A ROTARY KILN

[75] Inventor: Göran Wikström, Växjö, Sweden

[73] Assignee: Abb Flakt AB, Nacka, Sweden

[21] Appl. No.: 103,870

[22] PCT Filed: Sep. 17, 1991

[86] PCT No.: PCT/SE91/00621

§ 371 Date: Mar. 17, 1993

§ 102(e) Date: Mar. 17, 1993

[87] PCT Pub. No.: WO92/05394

PCT Pub. Date: Apr. 2, 1992

[30] Foreign Application Priority Data

Sep. 17, 1990 [SE] Sweden ..... 9002949-7

[51] Int. Cl.[5] ..... F27D 15/02

[52] U.S. Cl. ..... 432/80; 432/81; 432/233

[58] Field of Search ..... 432/77, 80, 81, 233

[56] References Cited

U.S. PATENT DOCUMENTS 3,290,029 4/1964 Niemitz .
4,226,584 10/1980 Ishikawa ..... 432/77
4,370,128 1/1983 Chielens et al. .
4,836,775 6/1989 Heithoff et al. .
4,973,245 11/1990 Monni ..... 432/77
5,097,773 3/1992 Freeman ..... 432/77

FOREIGN PATENT DOCUMENTS 218986 2/1910 Fed. Rep. of Germany .

*Primary Examiner*—Henry C. Yuen
*Attorney, Agent, or Firm*—Birch, Stewart, Kolasch & Birch

[57] ABSTRACT

In a method for cooling a rotary kiln having a cylindrical outer jacket, cooling air is blown at high speed radially towards the jacket from an annular supply-air chamber surrounding the jacket and having a perforated inner wall which is located at a slight distance from the jacket and through which the cooling air is blown towards the jacket. The cooling air is sucked out from the space between the jacket and the inner wall to an annular exhaust-air chamber which is separate from and surrounds the supply-air chamber and communicates with said space. The cooling-air flow through the chambers is adjusted by fan devices connected thereto. A device for implementing this method has an annular supply-air chamber surrounding the jacket and having a perforated inner wall which is located at a slight distance from the jacket and designed for radially blowing cooling air towards the jacket. An annular exhaust-air chamber, which is separate from and surrounds the supply-air chamber, communicates with the space between the jacket and the inner wall to conduct cooling air from this space. Fan devices are connected to the chambers in order to adjust the cooling-air flow therethrough.

5 Claims, 2 Drawing Sheets

METHOD AND DEVICE FOR COOLING A ROTARY KILN

BACKGROUND OF THE INVENTION

1. Field of the Invention

The present invention relates to a method and a device for cooling a rotary kiln having a cylindrical outer jacket.

2. Description Of Related Art

Rotary kilns with a cylindrical outer steel jacket and an inner ceramic lining are, for instance, used as cement kilns and lime sludge reburning kilns. They may also be employed for burning waste, e.g. hazardous waste. When a rotary kiln is used for combustion, the steel jacket and the lining are worn as a result of the high temperature in the kiln and the considerable variations in temperature that arise when the kiln rotates. In addition, both the steel jacket and the lining are mechanically worn as a result of the rotary motion, and the lining is also worn by chemical attack. In a rotary kiln employed for burning chemical waste, the lining and the steel jacket have to be replaced, wholly or partly, after about 6,000 and about 25,000 hours of operation, respectively. However, if the temperature of the jacket is reduced and maintained at a relatively constant level, the service life of both the jacket and the lining is much prolonged.

Efforts have therefore been made to cool rotary kilns. In prior-art methods, the jacket of the rotary kiln is cooled with the aid of water. Water-cooling is, however, extremely difficult to carry out in practice, since it requires an extremely water-tight enclosure of the kiln in order to make it possible to make use of the water steam or hot water formed upon the cooling, and also in order to protect the surroundings and the device which rotates the kiln. Naturally, water-cooling also involves problems of corrosion.

SUMMARY OF THE INVENTION

One object of the present invention is, therefore, to provide a simple and efficient method for cooling a rotary kiln.

According to the invention, this object is achieved by a method which is characterized in that cooling air is blown at high speed substantially radially towards the jacket from a supply-air chamber which surrounds said jacket over the main part of its circumference and extends over at least part of its axial extension, and which has an inner wall located at a slight distance from said jacket and formed with substantially radially directed perforations which are distributed over the supply-air chamber and through which the cooling air is blown towards said jacket, and that the cooling air is sucked out substantially radially from the space between the jacket and the inner wall of the supply-air chamber to an exhaust-air chamber which is separate from and surrounds the supply-air chamber and communicates with said space via tubes which are distributed throughout the supply-air chamber and extend substantially radially therethrough, the cooling-air flow through the chambers being adjusted by supply-air and exhaust-air devices connected to said chambers.

Another object of the invention is to provide a simple device for implementing this method.

According to the invention, this object is achieved by a device which is characterized by a supply-air chamber which surrounds said jacket over the main part of its circumference and extends over at least part of its axial extension and which has at least one cooling-air inlet and an inner wall located at a slight distance from said jacket and formed with substantially radially directed perforations which are distributed over the supply-air chamber and serve to blow cooling air towards said jacket in a substantially radial direction; an exhaust-air chamber which is separate from and surrounds the supply-air chamber and communicates with the space between the jacket and the inner wall of the supply-air chamber via tubes which are distributed throughout the supply-air chamber and extend substantially radially therethrough and which serve to conduct cooling air substantially radially from said space; as well as supply-air and exhaust-air devices which are connected to said chambers in order to adjust the cooling-air flow therethrough.

In a preferred embodiment, the cross-sectional area of the supply-air chamber decreases in the circumferential direction away from the respective cooling-air inlet.

The supply-air chamber is preferably annular, and the supply-air and exhaust-air devices are conveniently fan devices.

BRIEF DESCRIPTION OF THE DRAWINGS

The invention will now be described in more detail below, reference being had to the accompanying drawings, in which.

DETAILED DESCRIPTION OF PREFERRED EMBODIMENTS

Figure 1:
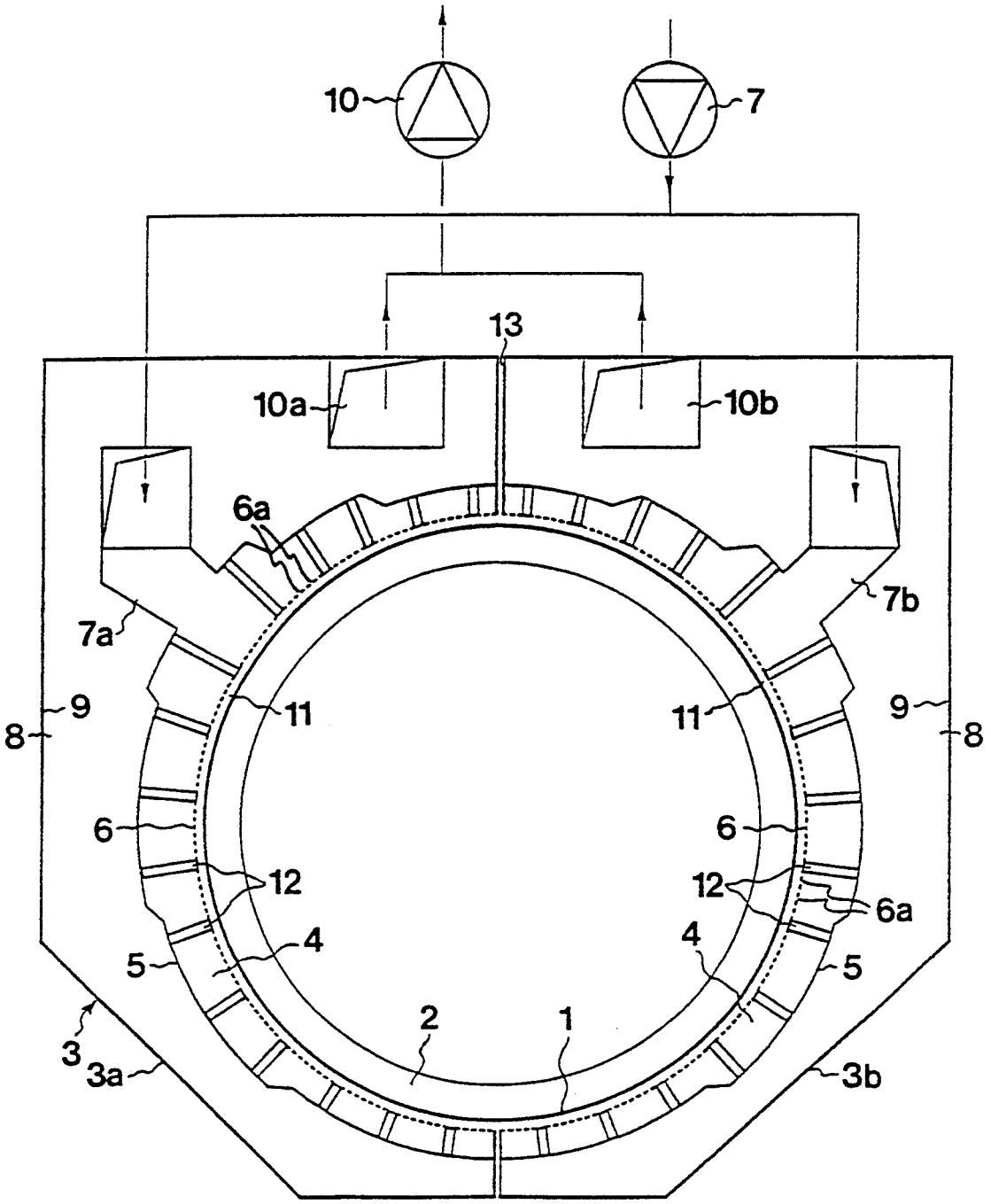
FIG. 1 is a schematic cross-section of a device according to the invention.
Figure 2:
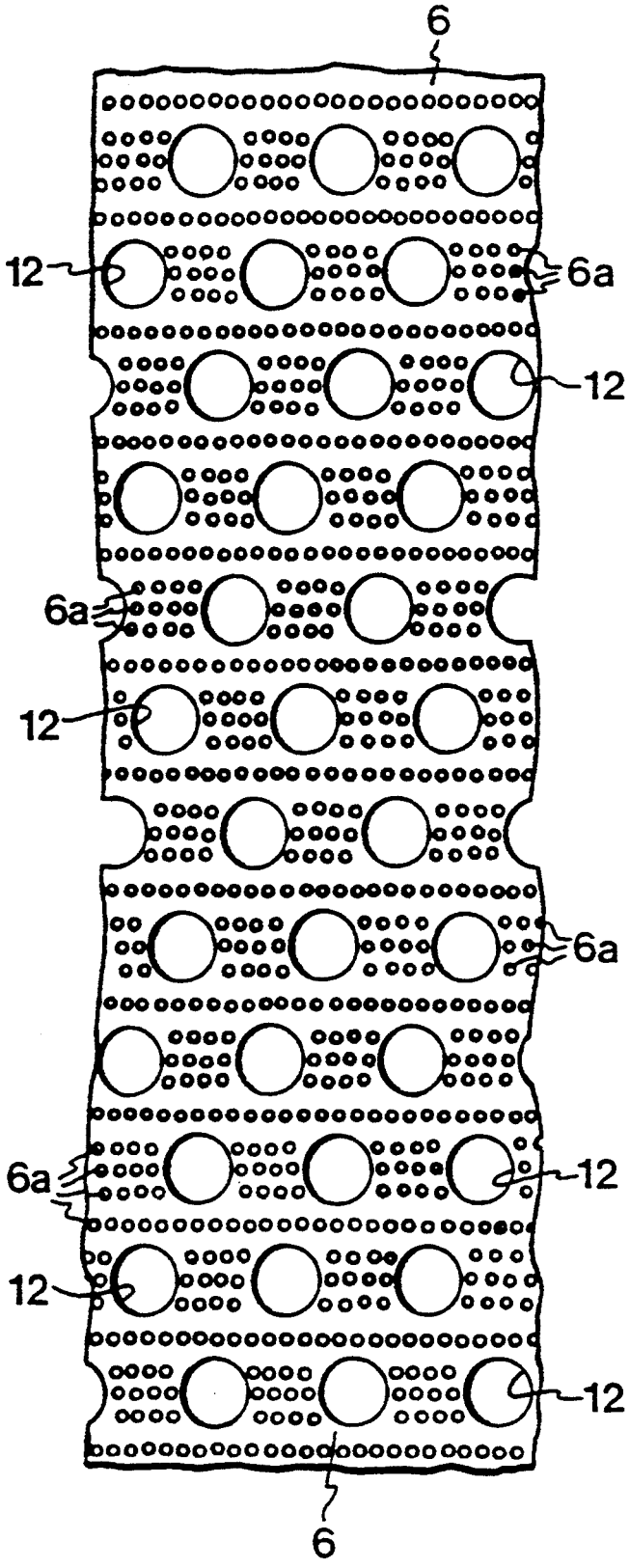
FIG. 2 illustrates a portion of a perforated wall of the device.

The drawings show a rotary kiln having a cylindrical outer steel jacket 1 and an inner ceramic lining 2. The rotary kiln is surrounded by an annular casing The casing 3 has an annular supply-air chamber 4 which is defined by an outer wall 5 and a perforated inner wall 6. The inner wall 6 is located at a slight distance from the jacket 1, and its perforations **6*a*, which are evenly distributed across its entire surface, are directed substantially radially towards the center of the rotary kiln. The supply-air chamber 4 has two cooling-air inlets 7*a* and 7*b* which are connected to a cooling-air-supply system including a fan device 7**.

Further, the casing 3 has an annular exhaust-air chamber 8 which surrounds the supply-air chamber 4 and is defined by the wall 5 and an outer wall 9. The exhaust-air chamber 8 has two cooling-air outlets **10*a* and 10*b*, which are connected to a cooling-air outlet system including a fan device 10. The exhaust-air chamber 8 communicates with the annular space 11 between the inner wall 6 of the supply-air chamber 4 and the jacket 1 via a plurality of tubes 12 which are evenly distributed throughout the entire supply-air chamber 4** and extend substantially radially therethrough.

A cooling-air flow for cooling the jacket 1 is generated with the aid of the fan device 7 connected to the cooling-air inlets **7*a* and 7*b* of the supply-air chamber 4, as well as the fan device 10 connected to the cooling-air outlets 10*a* and 10*b* of the exhaust-air chamber 8. The cooling air is blown into the supply-air chamber 4 through the inlets 7*a* and 7*b*, and is evenly distributed over the axial length of the chamber 4. The cooling air is driven away from the inlets 7*a* and 7*b* in the circumferential direction. When passing over the perforated inner wall 6, the cooling air flowing in the circumferential direction gives rise to radially directed cooling-air jets which at high speed impinge upon the jacket 1. The velocity of the cooling-air jets is maintained at such a high level that there is a satisfactory heat transfer between the jacket 1 and the cooling air. The heated cooling air is drawn into the exhaust-air chamber 8 through the tubes 12. Then, the heated cooling air, which may have a temperature of about 100° C., is drawn from the exhaust-air chamber 8 through the outlets 10***a* and 10*b* to be used e.g. as preheated air blown into the rotary kiln at the burner. The heated cooling air may also be employed for heating various premises.

Since the cooling air is blown into and sucked out of the space 11 in a substantially radial direction and evenly distributed over the surface of the jacket 1, there is no cooling-air flow over the jacket 1 in its circumferential or longitudinal direction, and the jacket is thus effectively cooled.

The radial extension, and consequently the cross-sectional area, of the supply-air chamber 4 decreases in the circumferential direction away from the cooling-air inlets 7*a* and 7*b*. Thus, the velocity of the cooling-air flow in the circumferential direction can be maintained constant or substantially constant around the entire supply-air chamber 4, despite the fact that the flow is gradually reduced as a result of the formation of radially directed cooling-air jets. In the embodiment shown, the decreasing cross-sectional area has been achieved by imparting a stepwise decreasing radius to the outer wall 5 of the supply-air chamber 4. Naturally, the outer wall 5 may have a continuously decreasing radius, but this requires a more complicated manufacturing technique.

The casing 3 illustrated in FIG. 1 is made up of two identical halves 3*a* and 3*b* which, in a manner not shown in detail, can be parted (laterally in the embodiment shown) to uncover the rotary kiln, e.g. when a power failure has interrupted the cooling-air supply, and enable air-cooling of the jacket 1 by natural convection.

At each end, the casing 3 has an end wall (not shown) extending transversely of the axis of the rotary kiln from the outer wall 9 of the exhaust-air chamber 8 towards the jacket 1. No particular sealing elements have been provided between the end walls and the rotating jacket 1. To prevent heated cooling air at the jacket ends from flowing out between the end walls and the jacket 1, the pressure $P_1$ in the space 11 between the inner wall 6 of the supply-air chamber 4 and the jacket 1 as well as the pressure $P_0$ outside the casing 3 are measured, whereupon the fan device 10 connected to the cooling-air outlets 10*a* and 10*b* of the exhaust-air chamber 8 is so controlled that $P_1$ is maintained slightly lower than $P_0$.

The device shown in the drawings may extend over part of the axial length of the rotary kiln, conveniently over its central portion where the cooling requirement is the highest. Naturally, the device may also extend over the entire length of the rotary kiln, but several devices of the type described may also be positioned axially after one another so as to cover part of or the entire length of the rotary kiln.

In the latter case, i.e. when several axially successive devices are used, an increased or reduced cooling effect may, if necessary, be applied to certain sections of the kiln length. The need of such application may, for instance, be established by means of a contactless temperature sensor (not shown), such as an IR sensor, which, when the kiln rotates, is moved to and fro along the kiln, e.g. in an upper gap 13 formed between the two halves 3*a* and 3*b* of the casing.

I claim:

1. A method for cooling a rotary kiln having a cylindrical outer jacket, comprising the steps of:

blowing cooling air at a high speed substantially radially towards the jacket from a supply-air chamber which surrounds said jacket over the main part of its circumference and extends over at least part of its axial extension and which has an inner wall located at a slight distance from said jacket and formed with substantially radially directed perforations which are distributed over the supply-air chamber and through which the cooling air is blown towards said jacket;

sucking the cooling air out substantially radially from the space between the jacket and the inner wall of the supply-air chamber to an exhaust-air chamber which is separate from and surrounds the supply-air chamber and communicates with said space via tubes which are distributed throughout the supply-air chamber and extend substantially radially therethrough; and adjusting the cooling-air flow through the chambers by supply-air and exhaust-air devices connected to said chambers.

2. The method of claim 1, wherein said supply-air chamber has at least one cooling-air inlet.

3. The method of claim 2, wherein the cross-sectional area of the supply-air chamber decreases in the circumferential direction away from the respective cooling-air inlet.

4. The method of claim 3, wherein the supply-air chamber is annular.

5. The method of claim claim 4, wherein the supply-air and exhaust-air devices are fan devices.

* * * * *